United States Patent [19]

Horst

[11] 4,284,715

[45] Aug. 18, 1981

[54] METHOD AND APPARATUS FOR FABRICATING A TRANSLUCENT GRADED DENSITY MEMBRANE

[75] Inventor: William R. Horst, Dayton, Ohio

[73] Assignee: NCR Corporation, Dayton, Ohio

[21] Appl. No.: 108,877

[22] Filed: Dec. 31, 1979

[51] Int. Cl.[3] ..... G03C 5/04

[52] U.S. Cl. ..... 430/395; 355/71; 430/396; 430/321; 430/494

[58] Field of Search ..... 430/395, 396, 951, 24, 430/321, 494; 355/71

[56] References Cited

U.S. PATENT DOCUMENTS

| | | | |
|---|---|---|---|
| 2,051,584 | 8/1936 | Van der Grinten | 430/396 X |
| 2,083,215 | 6/1937 | Balaban | 430/396 X |
| 2,150,805 | 3/1939 | Meulendyke | 430/396 |
| 3,224,352 | 12/1965 | Valette | 430/395 X |
| 3,394,003 | 7/1968 | Montani | 430/395 |
| 3,642,477 | 2/1972 | Trusheim | 430/396 |
| 3,694,079 | 9/1972 | Harvey | 355/71 X |
| 3,996,051 | 12/1976 | Meyerhofer | 430/355 |
| 4,021,831 | 5/1977 | Bercher | 355/71 X |
| 4,083,634 | 4/1978 | Momose et al. | 430/396 X |

*Primary Examiner*—Edward C. Kimlin

*Attorney, Agent, or Firm*—J. T. Cavender; Albert L. Sessler, Jr.; Jerrold J. Litzinger

[57] ABSTRACT

A method and apparatus for exposing a section of photographic medium such that it exhibits an incremental gradient in optical density across an area of the medium. A source of radiant energy is located in a container, which container is covered by a ground glass plate. This plate is covered by an opaque sheet, which sheet contains a narrow aperture. This sheet is covered by a second ground glass plate, such that the edge of the second plate overlies the edge of the aperture. A camera is focused on the surface of the opaque sheet. A portion of the light from the light source is diffused through the edge of the second plate and reflected toward the camera from the surface of the opaque sheet, causing the resultant image captured on the medium when the camera is activated to show a change in optical density with respect to the distance from the image on the medium of the edge of the second plate.

3 Claims, 4 Drawing Figures

900
800
700
600
500
400
300
200
100
0
DETECTOR OUTPUT CURRENT (IN μA)
30
28
26
.051
.102
.153
.204
.255
DISPLACEMENT ACROSS FILM STRIP (CM)

METHOD AND APPARATUS FOR FABRICATING A TRANSLUCENT GRADED DENSITY MEMBRANE

CROSS-REFERENCE TO A RELATED APPLICATION

The present application is related to the copending U.S. Patent Application of William R. Horst and Robert H. Granzow, entitled "Currency Dispenser Monitor", Ser. No. 108,874, filed on the same day as the present application and assigned to the same assignee.

BACKGROUND OF THE INVENTION

The present invention relates generally to a method of exposing photographic medium, and, in particular, a method for fabricating a translucent graded density membrane type medium which may, among other uses, be used for measurement of mechanical motion or displacement.

Such displacement measurement is useful in a number of different environments, including currency dispenser systems. The reliability of currency dispenser systems, such as those employed in remote teller terminals, depends critically on the accuracy in the monitoring of its performance. A unique method of accomplishing the monitoring function is disclosed in the pending application by William R. Horst and Robert H. Granzow, Ser. No. 108,874, which is assigned to the assignee of the present application, and is hereby fully incorporated into this application by reference. Monitoring is achieved in that invention by the use of a translucent graded density medium or filmstrip which is attached to a mechanical arm, which arm is displaced according to the thickness of a bill. The position of the filmstrip causes an analog electrical signal to be generated with an amplitude proportional to the displacement of the arm. Minimal mechanical load and no restraining forces are imposed on the arm, due to the small, lightweight filmstrip and associated optical system. This method provides a very rapid response using a high level TTL compatible signal output.

Other monitoring systems exist which optically detect a transition at the edge of a document when the document reaches a predetermined position, or which sense a detecting member physically traveling to a certain point; these systems seem to operate in a similar manner as the device disclosed in Ser. No. 108,874. However, a major difference lies in the design of the filmstrip and its interaction with the detector unit to provide an analog output signal, rather than a simple binary indication, which signal is relative to the actual physical position of the filmstrip.

SUMMARY OF THE INVENTION

It is therefore an object of this invention to fabricate a translucent medium which has an optical density which constitutes an incrementally changing gradient from dark to light.

It is a further object of this invention to provide an inexpensive and simple way of producing a graded density medium.

It is still a further object of this invention to provide a medium which, when used in conjunction with a detector, can generate an analog output signal that is proportional to the physical position of the filmstrip.

These and other objects are accomplished in the present instance by using a photographic contact printing box to expose photographic medium in such a manner as to produce a translucent portion of graded optical density. Two ground glass plates scatter the light from a source of radiant energy, causing the amount of light striking the medium to decrease in proportion to the distance from the edge of one of the plates.

DESCRIPTION OF THE PREFERRED EMBODIMENT

Figure 1:
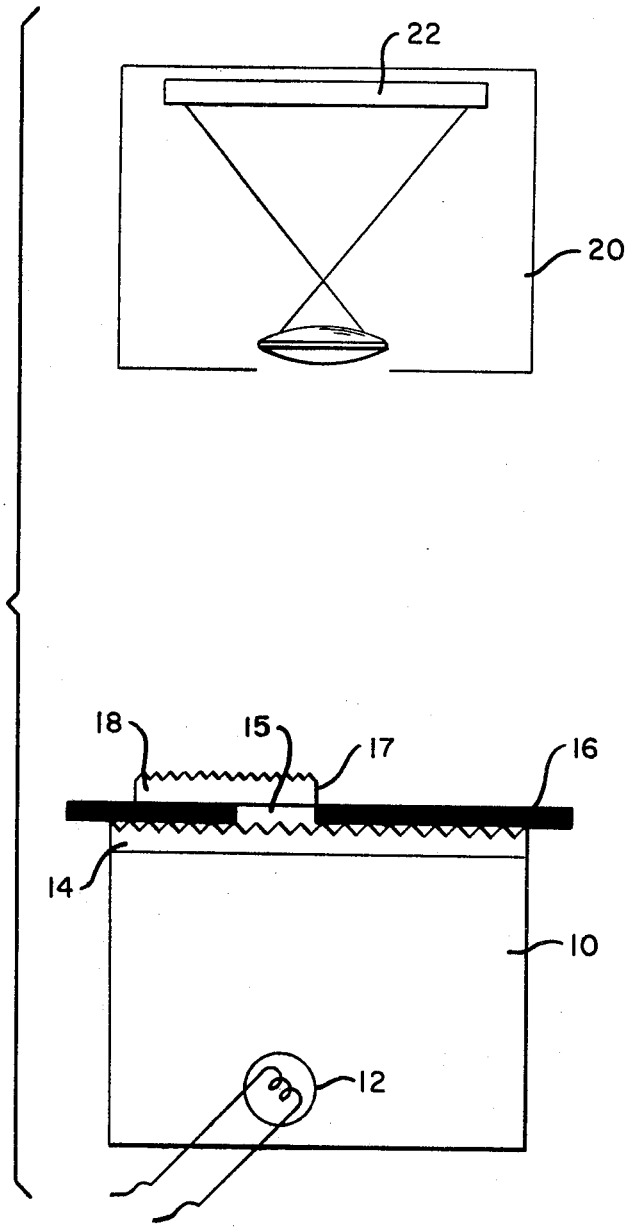
FIG. 1 is a front view of an apparatus according to the present invention.

FIG. 1 shows an embodiment which may be used to correctly expose the film of the present invention. It is, of course, understood that this embodiment is shown for purposes of illustration, and that the invention is not limited by the specific dimensions, film types, etc. recited herein. The base unit comprises a photographic contact printing box 10 containing a tungsten lamp 12 at the closed end. The open end of the unit 10 is covered with a round glass diffusion plate 14, which plate is positioned with its rough side facing away from lamp 12. A sheet of black opaque photographic paper 16 covers the rough side of plate 14 with the exception of a narrow aperture 15, which is 1.27 centimeters wide, across the center of plate 14. A second ground glass diffusion plate 18 with a thickness of 0.318 centimeters covers a portion of paper 16, such that the right edge 17 of plate 18 overlaps the opening 15 of paper 16 by an amount sufficient to prevent light leakage between paper 16 and plate 18.

A camera 20, which may be a Polaroid type MP-3 camera, is focused on the surface of paper 16 at a distance which causes the length of the image of the 1.27 centimeter wide aperture 15 of paper 16 to reach across the film 22 in camera 20. Film 22, which may be Polaroid type 55P/N film, is chosen such that it produces a negative transparency when exposed, and eliminates the need for external processing.

Figure 2:
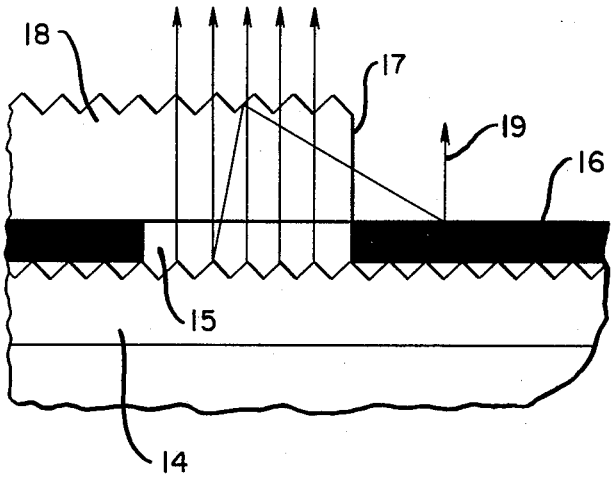
FIG. 2 is a fragmentary view of the aperture area of the apparatus shown in FIG. 1.

When camera 20 is activated, light from lamp 12 passes through plate 14, the aperture 15 in paper 16, and plate 18 and exposes film 22, causing the area of film 22 corresponding to the 1.27 centimeter wide aperture 15 to be heavily exposed (dark on development). However, a portion of the light from lamp 12 is diffused as it passes through the rough surface of plate 14, as represented by path 19 in FIG. 2. The light is further scattered by the rough surface of plate 18. As a result, some of the light is reflected through edge 17 of plate 18 onto the surface of paper 16, and reflected therefrom. The amount of light which is diffused onto paper 16 decreases rapidly as the distance from edge 17 of plate 18 increases. Due to surface reflectivity of paper 16, the light exposes film 22 in proportion to the distance from edge 17. The resultant image on film 22 shows a dark section corresponding to aperture 15, which becomes lighter as the distance from the image of edge 17 increases.

In the present embodiment, film 22 was exposed for a period of 105 seconds, creating a film strip with the desired qualities for use in the aforementioned currency dispenser monitor. However, the exposure time may be adjusted to generate a film strip with the proper gradient for other applications.

The graded-density film strip created in the present invention can be an efficient means for extending the operating range of a photodetector. Some photodetector units, such as type H17B1 manufactured by General Electric, have an active optical area of only 0.050 to 0.075 centimeters in length. Therefore, any operating mechanism which contains a sharp opaque-to-transparent transition line can be moved only that distance to control the detector. By using a graded-density film strip to control the detector, the total range of motion measurable by the detector can be expanded significantly.

Figure 3:
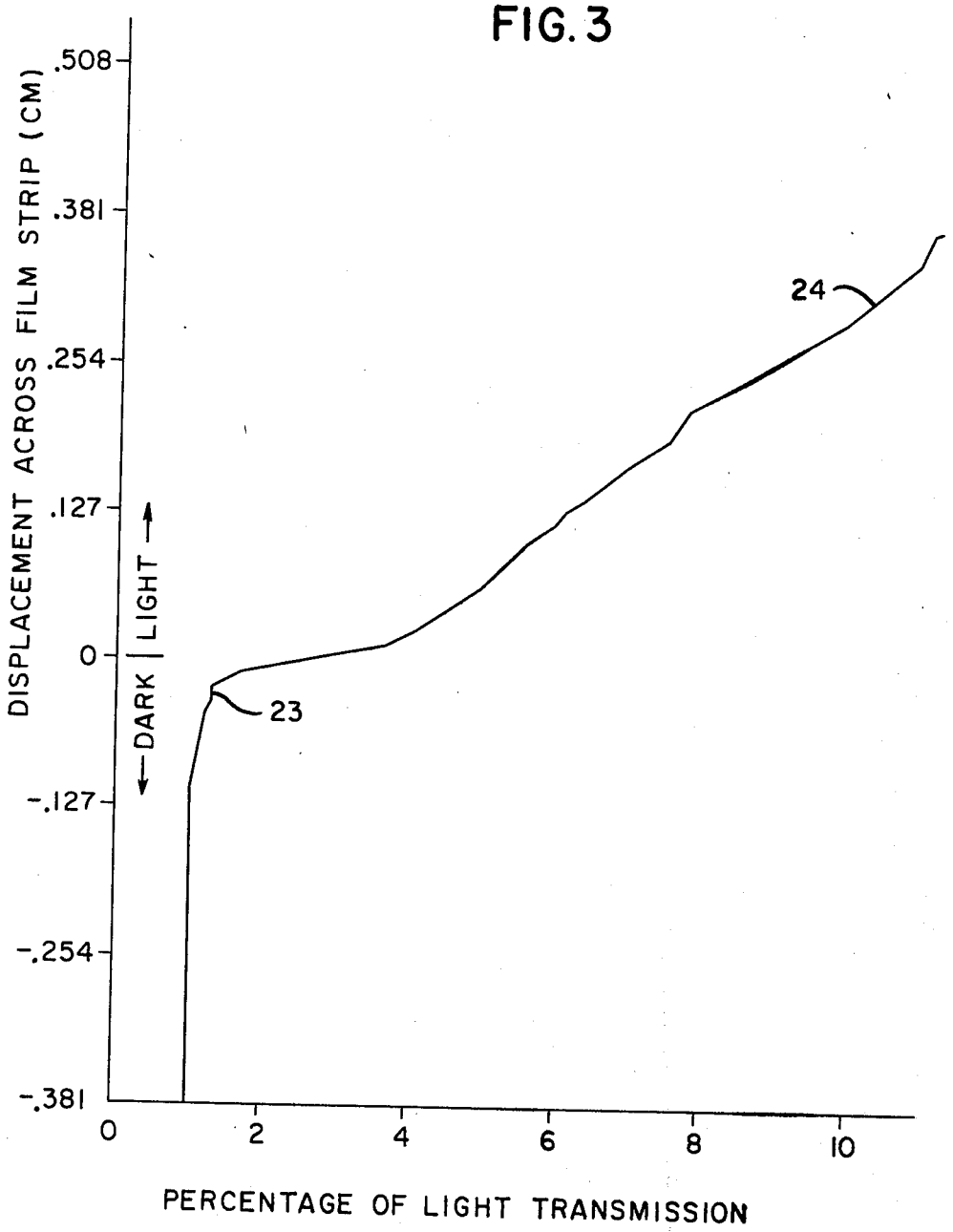
FIG. 3 is a graph showing the density of the film strip of the present invention with respect to the distance across the film strip.

FIG. 3 is a graph which plots the density of exposure as a percentage of light transmission through a film strip created in the present invention with respect to the position of the film strip as measured by a microdensitometer. FIG. 3 shows that the percentage of light transmission increases linearly as the distance increases from the point 23 on curve 24 when the film portion being sensed is centered on the transition line corresponding to the image of the edge 17 of plate 18 (FIG. 1) on the film. As sensing of the film is shifted toward and into the fully exposed region, the percentage of light transmission rapidly decreases to a substantially constant value.

Figure 4:
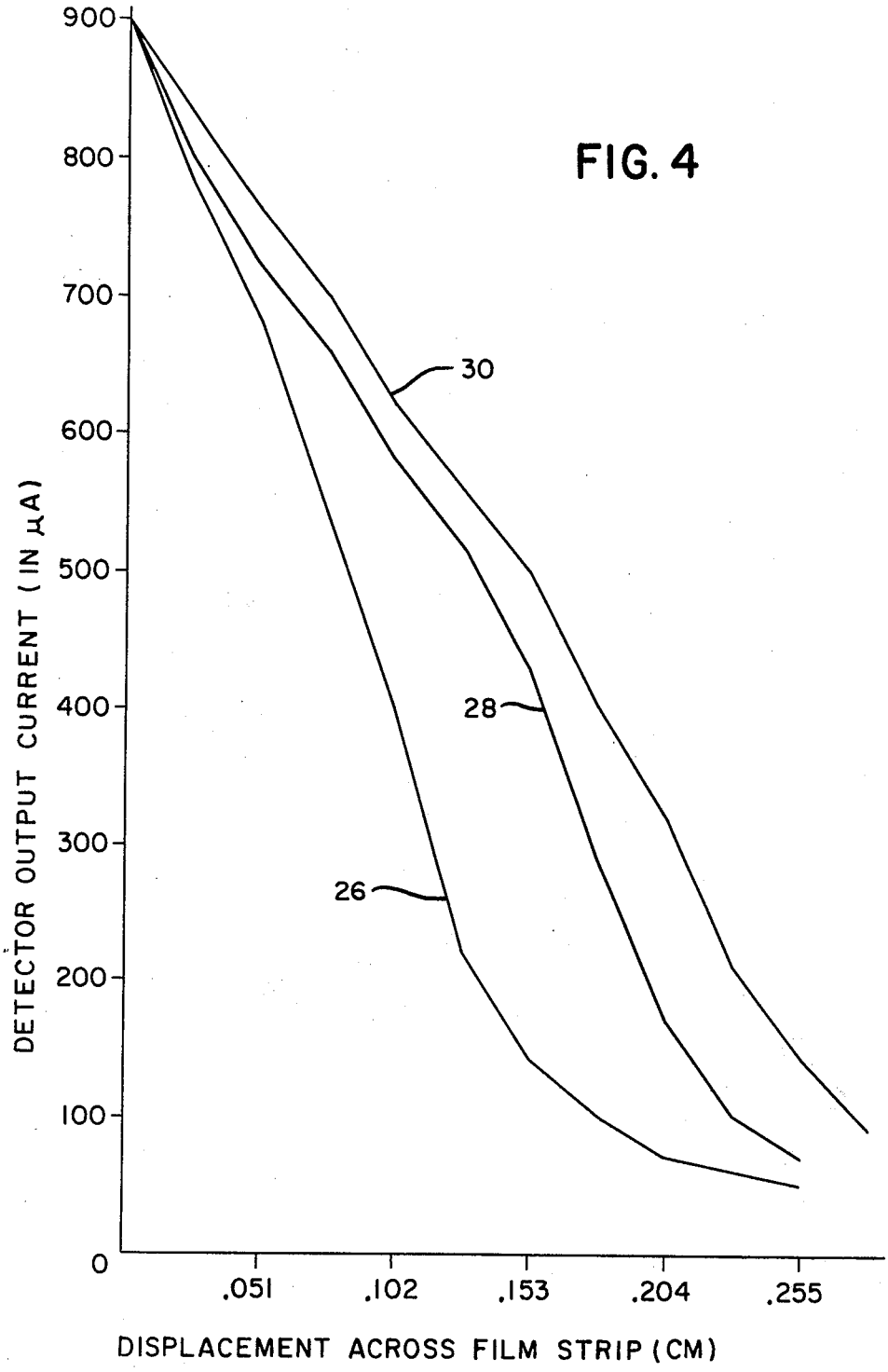
FIG. 4 is a graph showing the output current of a detector unit with respect to the distance across several film strips which were exposed for different periods of time.

The microdensitometer uses a precise reading spot which is 0.028 centimeters in diameter, and which provides a very accurate measurement. However, when the film strip is used in conjunction with a commercially available detector, such as the G.E. H17B1, the reading spot is significantly larger, which can have an effect on the operating range. FIG. 4 is a graph which plots the output current of a H17B1 detector with respect to several film strips which were created using the method disclosed in the present invention. Curve 28 shows the output current of the detector as a function of the distance across a film strip from the edge 17 image line (FIG. 1), where the film strip was exposed for 105 seconds. Curve 26 shows the detector output versus a film strip with a 90 second exposure time, and curve 30 represents the detector output plotted against a film strip with a 120 second exposure. Referring to FIG. 4, it can be seen that the output current decreases as the distance from the edge image is increased for all the film strips, but that the relationship displays the best linearity in curve 28, using the 105 second time exposure. Also, the linear relationship covers a minimum of 0.254 centimeters, which will allow for a significant expansion of the total range of motion measurable by the detector.

While the invention has been shown and described in terms of a specific embodiment thereof, it will be understood that the invention is not limited to this particular embodiment, and that many changes and modifications may be made without departing from the spirit and scope of the invention as defined in the appended claims. For example, a thin photographically sensitive glass plate may be used in place of photographic film, or any source of radiant energy may be substituted for the tungsten lamp.

I claim:

1. A method for fabricating a translucent graded density film, comprising the steps of:

providing a source of light;

diffusing light from said source;

blocking a portion of said diffused light with an apertured opaque element which allows passage of the remainder of said diffused light through said aperture;

further diffusing said light passing through said aperture and causing a portion of said further diffused light to be reflected from the substantially opaque surface of said apertured element; and exposing a photosensitive film to said light passing through said aperture and said light reflected from said substantially opaque surface to produce a film exhibiting an incremental gradient in optical density across an area of the film.

2. The method of claim 1 in which the step of exposing a photosensitive film includes the steps of focusing said light passing through said aperture and said reflected light in the plane of said film and causing said light to impinge on said film for a predetermined period of time.

3. A method for fabricating a translucent graded density medium, comprising the steps of:

providing a source of radiant energy;

diffusing radiant energy from said source;

blocking a portion of said diffused radiant energy with an apertured opaque element which allows passage of the remainder of said diffused radiant energy through said aperture;

further diffusing said radiant energy passing through said aperture and causing a portion of said further diffused radiant energy to be reflected from the substantially opaque surface of said apertured element;

and exposing a photosensitive film to said radiant energy passing through said aperture and said radiant energy reflected from said substantially opaque surface to produce a medium exhibiting an incremental gradient in optical density across an area of said medium.

* * * * *